US006683412B2

(12) United States Patent
Ingalls et al.

(10) Patent No.: US 6,683,412 B2
(45) Date of Patent: Jan. 27, 2004

(54) HIGH PRESSURE SODIUM LAMP HAVING REDUCED INTERNAL DIAMETER

(75) Inventors: Paul H. Ingalls, Penacock, NH (US); Robert Dolan, Manchester, NH (US); Elliot Wyner, Peabody, MA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/181,731

(22) PCT Filed: Jan. 17, 2001

(86) PCT No.: PCT/US01/01393

§ 371 (c)(1),
(2), (4) Date: Oct. 24, 2002

(87) PCT Pub. No.: WO01/54156

PCT Pub. Date: Jul. 26, 2001

(65) Prior Publication Data

US 2003/0222582 A1 Dec. 4, 2003

Related U.S. Application Data

(60) Provisional application No. 60/177,158, filed on Jan. 20, 2000.

(51) Int. Cl.[7] ..... H01J 61/12
(52) U.S. Cl. ..... 313/571; 313/573
(58) Field of Search ..... 313/25, 44, 570, 313/571, 573, 670, 623, 621, 634, 640

(56) References Cited

U.S. PATENT DOCUMENTS

| | | | |
|---|---|---|---|
| 4,134,039 | A | 1/1979 | Vida et al. |
| 4,171,498 | A | 10/1979 | Fromm et al. |
| 5,097,176 | A | 3/1992 | De Hair et al. |
| 5,101,134 | A | 3/1992 | Rothwell, Jr. et al. |
| 5,144,201 | A | 9/1992 | Graham et al. |

*Primary Examiner*—Nimeshkumar D. Patel
*Assistant Examiner*—Joseph Williams
(74) *Attorney, Agent, or Firm*—Young & Thompson

(57) ABSTRACT

A high pressure sodium lamp (100) having an evacuated glass envelope (6) with a plurality of electrically conductive support members therein and extending therethrough. An elongated arc tube (14) having a pair of electrodes (26) extending therethrough is affixed to the electrically conductive support members within the glass envelope. A gas fill includes a quantity of mercury and sodium within the elongated tube. The arc tube is selected from a translucent material that, when the lamp is operating, will have a wall temperature of about 1250 degrees Celsius, a wall loading of from about 18.9 to about 22.2 w/cm sqr., and a power consumption of from 150 to 400 watts. Further, the amount of mercury is reduced from 14.4 mgs/arc tube to 10.8 mgs/arc tube, allowing lamps having power consumption from 150 to 400 watts to pass the Toxicity Characteristics Leaching Procedure (TCLP).

7 Claims, 1 Drawing Sheet

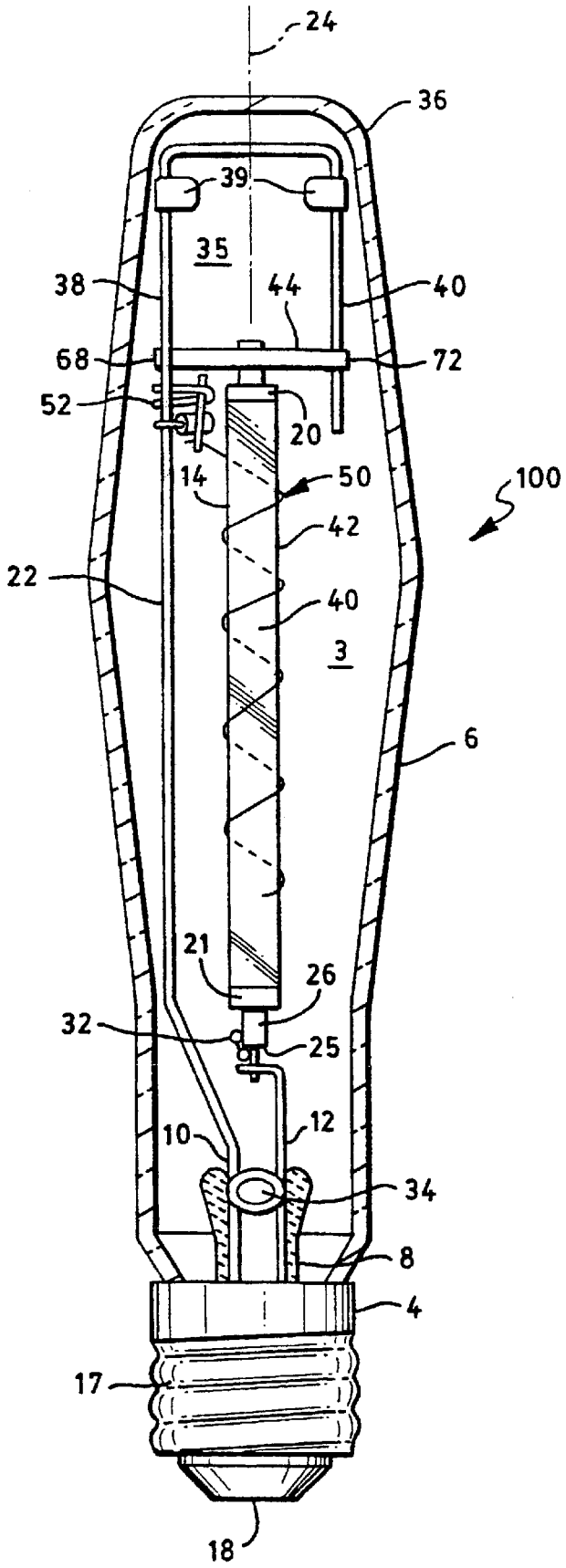
24
36
39
35
38
44
40
68
72
52
20
14
50
100
42
22
40
3
6
21
26
32
25
12
10
34
8
4
17
18

HIGH PRESSURE SODIUM LAMP HAVING REDUCED INTERNAL DIAMETER

This application claims priority from Provisional Patent Application No. 60/177,158, filed Jan. 20, 2000.

TECHNICAL FIELD

This invention relates to high pressure sodium lamps and more particularly to such lamps having an arc tube of reduced size, lower cost and greater efficiency.

Additionally, these lamps operate at high temperature and with reduced mercury thus allowing these lamps to pass the Toxicity Characteristic Leaching Procedure (TCLP).

BACKGROUND ART

High pressure sodium (HPS) lamps are in wide use worldwide because of their high efficacy, long life and acceptable color rendering properties. The acceptable commercial development of these lamps is generally attributed to the creation of arc tubes of translucent polycrystalline alumina (PCA), this being the first material that could be manufactured economically that would provide acceptable optical properties and yet withstand the attack of the sodium vapor.

Recently, improved versions of PCA have been developed that, under proper conditions, will allow operation of HPS lamps at high temperatures. These materials are disclosed in U.S. Pat. Nos. 4,285,732; 5,625,256; and 5,682,082.

It would be an advance in the art if HPS lamps could be developed that used these materials to provide increased efficacy and reduced cost. Further, it would be a definite advance in the art if such lamps could be built which would reduce pollution by passing the government instituted Toxicity Characteristics Leaching Procedure (TCLP) allowing conventional disposal in land-fills.

DISCLOSURE OF INVENTION

It is, therefore, an object of this invention to obviate the disadvantages of the prior art.

It is another object of the invention to enhance HPS lamps.

Yet another object of the invention is the reduction in cost of providing such HPS lamps.

Still another object of the invention is an increase in efficacy of HPS lamps together with a reduction in the amount of mercury employed.

These objects are accomplished, in one aspect of the invention, by a high pressure sodium lamp having an evacuated glass envelope with a plurality of electrically conductive support members therein and extending therethrough. An elongated arc tube having a pair of electrodes extending therethrough is affixed to the electrically conductive support members within the glass envelope. A gas fill includes a quantity of mercury and sodium within the elongated arc tube. The arc tube is selected from a translucent material that, when the lamp is operating, will have a wall temperature of about 1250° C., a wall loading of from about 18.9 to about 22.2 w/cm$^2$, and a power consumption of from 150 to 400 watts.

Further, the amount of mercury is reduced from 14.4 mgs/arc tube to 10.8 mgs/arc tube, allowing lamps having power consumption's from 150 to 400 watts to pass TCLP.

BRIEF DESCRIPTION OF THE DRAWINGS

The single FIGURE illustrates a typical HPS lamp, in elevational cross-section.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Referring now to the drawing with greater particularity, there is shown a high pressure sodium vapor lamp 100 having a vitreous outer envelope 6 with a standard mogul screw base 4 attached to the stem end which is shown lowermost in the figure. A reentrant stem press 8 has a pair of relatively heavy lead-in conductors 10 and 12 extending through the stem 8 and having outer ends of conductors 10 and 12 connected to the screw shell 17 and eyelet 18.

The lamp 100 has an inner envelope or arc tube 14 centrally located within the outer envelope 6. The arc tube 14 is comprised of a length of light transmitting ceramic formed of polycrystalline alumina ceramic that is translucent. The arc tube 14 contains a charge of vaporizable metal which may include the addition of a metal buffer gas such a mercury with an operating range of 0.1 to 5 atmospheres (101.3 to 5066.2 mbar) and having an emitting species of sodium at a typical operating pressure of 60 Torr (80 mbar) or higher. In a preferred embodiment of this invention the mercury pressure is from 474 mbar to 868 mbar, and the sodium pressure is from about 124 mbar to about 153 mbar (93 to 114 Torr). The upper end of the arc tube 14 is closed by an alumina ceramic plug 20 through which a niobium in-lead 26 projects and which supports an upper electrode (not shown) within the arc tube 14. The lower end of arc tube 14 has a closure which comprises a ceramic plug 21 through which extends a thin-walled niobium tube 26. The niobium tube 26 serves as an in-lead for arc tube 14. The shank of the lower electrode (not shown) of arc tube 14 projects into tube 26 and is locked in place by crimping the tube 26 about the lower electrode at location 25. The arc tube 14 has a tungsten wire 50 coiled thereabout. The wire 50 is connected to one of the electrodes by a thermal switch 52 and is placed between the electrodes where the lowest breakdown voltage is achieved. The thermal switch opens when the lamp is warm so as to minimize electric fields across the tube wall.

The following Tables indicate the differences between the standard arc tube dimensions and those available with the new arc tubes, with Tables I and III illustrating the old and Tables II and IV the new.

TABLE I

Standard Arc Tube Dimensions

| Type | Bore mm | Wall mm | Arc Length mm | Loading w/cm$^2$ | Wall Temp |
|---|---|---|---|---|---|
| 400WS51 | 7.32 | .83 | 84.6 | 17.7 | 1200° C. |
| 250WS50 | 5.87 | .76 | 69.6 | 16.8 | 1190° C. |
| 200WS66 | 5.87 | .76 | 63.6 | 14.7 | 1170° C. |
| 150WS55 | 5.87 | .76 | 39.0 | 17.4 | 1190° C. |

TABLE II

| Downsized Arc Tube Dimensions | | | | | |
|---|---|---|---|---|---|
| Type | Bore mm | Wall mm | Arc Length mm | Loading w/cm$^2$ | Wall Temp |
| 400WS51 | 6.62 | .76 | 82.2 | 20.2 | 1250° C. |
| 250WS50 | 5.21 | .76 | 70.0 | 18.9 | 1250° C. |
| 200WS66 | 4.78 | .76 | 58.4 | 19.7 | 1250° C. |
| 150WS55 | 5.21 | .76 | 35.6 | 22.2 | 1250° C. |

TABLE III

| Standard Arc Tube Dimensions | | | | | | |
|---|---|---|---|---|---|---|
| Type | Volts | NaP mbar | HgP mbar | D Line | NaQ Mgs | HgQ mgs |
| 400WS51 | 100 | 131 | 463 | 105 | 4.8 | 14.4 |
| 250WS50 | 100 | 110 | 738 | 85 | 3.6 | 14.4 |
| 200WS66 | 100 | 111 | 760 | 95 | 3.6 | 14.4 |
| 150WS55 | 55 | 136 | 574 | 85 | 4.8 | 14.4 |

TABLE IV

| Downsized Arc Tube Dimensions | | | | | | |
|---|---|---|---|---|---|---|
| Type | Volts | NaP mbar | HgP mbar | D Line | NaQ Mgs | HgQ mgs |
| 400WS51 | 100 | 136 | 474 | 90 | 3.6 | 10.8 |
| 250WS50 | 100 | 135 | 536 | 85 | 3.6 | 10.8 |
| 200WS66 | 100 | 124 | 868 | 85 | 2.7 | 10.8 |
| 150WS55 | 55 | 153 | 642 | 85 | 3.6 | 10.8 |

In the Tables, NaP and HgP stand for sodium pressure and mercury pressure, respectively; and NaQ and HgQ stand for sodium quantity and mercury quantity, respectively.

As will be seen from a comparison of the standard arc tube dimensions and the new arc tube dimensions, the new arc tubes provide good economic value that results from the reduced material content in the ceramic arc tube body and further provides energy savings from the higher lamp efficiency. Additionally, the reduced mercury content allows these new lamps to pass the TCLP. The utilization of the new materials also allows operation at higher wall temperatures providing improved lamp operating efficiency.

While there have been shown and described what are at present considered the preferred embodiments of the invention, it will be apparent to those skilled in the art that various changes and modifications can be made herein without departing from the scope of the invention as defined by the appended claims.

What is claimed is:

1. In a high pressure sodium lamp having an evacuated glass envelope with a plurality of electrically conductive support members therein and extending therethrough; an elongated arc tube having a pair of electrodes extending therethrough and affixed to said electrically conductive support members within said glass envelope; a gas fill including a quantity of mercury and sodium within said elongated arc tube, the improvement comprising:

said arc tube being selected from a translucent material that, when said lamp is operating, will have a wall temperature of about 125° C., a wall loading of from about 18.9 to about 22.2 w/cm$^2$, and a power consumption of from 150 to 400 watts.

2. The high pressure sodium lamp of claim 1 wherein said quantity of mercury is about 10.8 mgs.

3. The high pressure sodium lamp of claim 1 wherein said lamp has a power consumption of from 150 to 400 watts.

4. The high pressure sodium lamp of claim 3 wherein said lamp has a power consumption of 400 watts and said arc tube has an internal diameter of 6.62 mm.

5. The high pressure sodium lamp of claim 3 wherein said lamp has a power consumption of 250 watts and said arc tube has an internal diameter of 5.21 mm.

6. The high pressure sodium lamp of claim 3 wherein said lamp has a power consumption of 200 watts and said arc tube has an internal diameter of 4.78 mm.

7. The high pressure sodium lamp of claim 3 wherein said lamp has a power consumption of 150 watts and said arc tube has an internal diameter of 5.21 mm.

* * * * *